US007125316B2

(12) United States Patent
Baeumler

(10) Patent No.: US 7,125,316 B2
(45) Date of Patent: Oct. 24, 2006

(54) METHOD AND DEVICE FOR PRODUCING MOLDS FOR TOOTHED BELTS

(76) Inventor: Peter Baeumler, Petronellastrasse 7, Aachen (DE) 52066

( * ) Notice: Subject to any disclaimer, the term of this patent is extended or adjusted under 35 U.S.C. 154(b) by 250 days.

(21) Appl. No.: 10/432,476

(22) PCT Filed: Nov. 28, 2001

(86) PCT No.: PCT/DE01/04471

§ 371 (c)(1),
(2), (4) Date: May 22, 2003

(87) PCT Pub. No.: WO02/43919

PCT Pub. Date: Jun. 6, 2002

(65) Prior Publication Data

US 2004/0029497 A1 Feb. 12, 2004

(30) Foreign Application Priority Data

Nov. 28, 2000 (DE) ..... 10059067

(51) Int. Cl.
*B24B 1/00* (2006.01)

(52) U.S. Cl. ..... 451/21; 451/5; 451/49; 451/56; 451/212; 451/214

(58) Field of Classification Search ..... 451/242, 451/246, 251, 72, 56, 21, 212, 214, 403, 451/227, 47, 5, 547, 49; 409/132, 75, 76, 409/165, 198; 164/6, 480, 428, 139; 72/224, 72/100; 76/107.1
See application file for complete search history.

(56) References Cited

U.S. PATENT DOCUMENTS 1,753,707 A * 4/1930 Lamborn ..... 451/49
1,780,747 A * 11/1930 Ellis ..... 451/49
3,299,577 A 1/1967 Pernack et al.
3,819,405 A * 6/1974 Engle ..... 427/393.5
3,877,179 A 4/1975 Hammann
4,322,916 A * 4/1982 Richmond ..... 451/188
4,329,192 A * 5/1982 White et al. ..... 156/138
4,343,666 A * 8/1982 Wetzel ..... 156/138
4,359,841 A * 11/1982 Barth et al. ..... 451/5
4,515,743 A * 5/1985 Breher ..... 264/135
4,936,051 A * 6/1990 Waelti ..... 451/72
4,971,602 A 11/1990 Crawford
5,335,456 A * 8/1994 Mishima ..... 451/28

(Continued)

FOREIGN PATENT DOCUMENTS

DE 1 577 534 3/1970

(Continued)

OTHER PUBLICATIONS

Koenig, W., & Meijboom, H.M.,: Surfacing profile grinding disks for grinding the flanks of teeth, in: VDI-Z 121, 1979, No. 21, pp. 1087 to 1092.

(Continued)

*Primary Examiner*—Jacob K. Ackun, Jr.
(74) *Attorney, Agent, or Firm*—Jordan and Hamburg LLP

(57) ABSTRACT

The invention relates to a method and to a device for producing molds for toothed belts. A grinding wheel (9) that has a profiled periphery is used instead of a milling cutter to provide the circumference of a roller-shaped blank (4) with the matrix of a desired tooth contour of a toothed belt. The circumferential profile of the grinding wheel (9) is trimmed using a CNC-controlled diamond trimming pin (11) or alternatively with a profiling diamond (19).

6 Claims, 2 Drawing Sheets

U.S. PATENT DOCUMENTS

Figure 1:
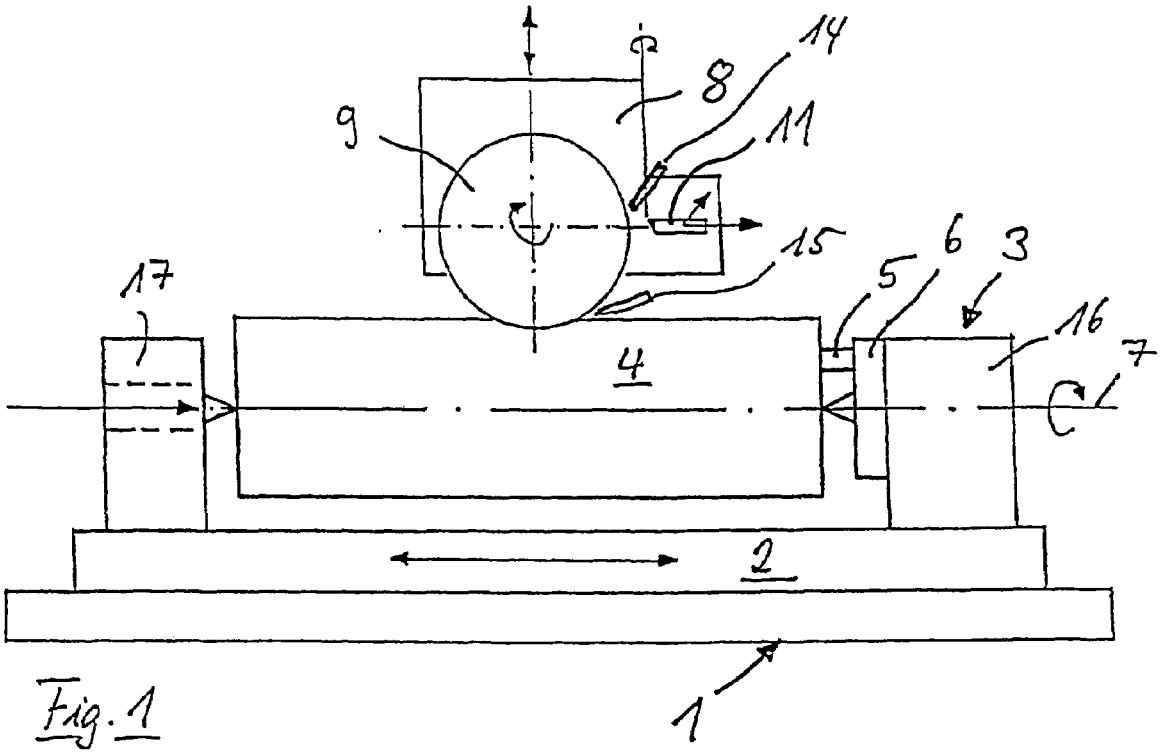

| | | | | |
|---|---|---|---|---|
| 5,595,528 | A * | 1/1997 | Becker | 451/72 |
| 6,030,279 | A | 2/2000 | Russell | |
| 6,113,474 | A * | 9/2000 | Shih et al. | 451/72 |
| 6,461,228 | B1 * | 10/2002 | Stocker et al. | 451/44 |

FOREIGN PATENT DOCUMENTS

| | | |
|---|---|---|
| DE | 32 39 914 | 5/1984 |
| DE | 34 38 917 | 4/1986 |
| DE | 38 25 465 | 2/1989 |
| DE | 43 02 353 | 8/1993 |
| DE | 44 46 275 | 7/1995 |
| GB | 1 082 418 | 9/1967 |
| GB | 1 253 685 | 11/1971 |
| JP | 54-31992 | 3/1979 |
| JP | 55-37201 | 3/1980 |
| JP | 61-197161 | 9/1986 |
| JP | 1-177956 | 7/1989 |
| JP | 3-186638 | 8/1991 |
| JP | 04063619 | 2/1992 |
| WO | 00-66903 | 11/2000 |

OTHER PUBLICATIONS

Brochure "MB 1"; ELB, Blohm and Maegerle, before 1994, the Opposer refers to the disclosure on p. 7 of this brochure, in which a profiled grinding machine is shown, which is used for processing a pressure roller for producing corrugated cardboard.

Brochure "MB 2"; The brochure of Fa. Blohm, which carries the imprint "Aug. 1998" on the last page and, therefore no doubt originates from 1998, shows profile grinding of steering pinions on the last page carrying the heading "Flexibility with new spindle drive".

Brochure "MB 3"; the brochure Fa. "Maegerle" is not suitable as state of the art. The Opposer in the litigation assumes quite generally, that because of the complexity and diversity of the profile grinding machines offered in the brochure, it may be taken for granted that this company has offered corresponding profile machines already before the priority date of the patent application in question here.

Brochure "MB 4"; the brochure carrying the imprint Jun. 1997, on the last page, the Opposer refers to the procedure claimed in the dependent claims 2 to 4.

Concise Explanation of Relevancy of Letter of Blohm dated Feb. 22, 1993 and attachments Profile grinding of molds for the production of V-belts and toothed belts.

concise Explanation of Relevancy of PRESTA document dated Nov. 7, 1994 and its attachment.

* cited by examiner

METHOD AND DEVICE FOR PRODUCING MOLDS FOR TOOTHED BELTS

The present invention relates to a method and a device for producing molds for toothed belts.

Molds for toothed belts are typically tubular steel rollers which are toothed linearly on their peripheral surface and are required as an inner core in the production of toothed belts, from Perbunan rubber or plastic, for example. The heated toothed belt material is pressed into the teeth of the mold for toothed belts. The toothing of the molds for toothed belts thus forms the matrices of the toothed belt toothing.

Producing molds for toothed belts from cylindrical blanks by milling is known. The requirements for the precision of the tooth geometries of toothed belts have increased enormously. Thus, the tooth surface is to be as smooth as possible, i.e., if possible, is not to have any imaging of the milling marks present in the molds for toothed belts.

Post-treatment of the surface of the molds for toothed belts is therefore typically necessary if the molds for toothed belts are milled. In addition, the multiplicity of tooth geometries has increased, which is to meet the demands for higher performance and quiet running.

It is thus the object of the present invention to provide a method and a device of the type initially cited, using which, in addition to high geometrical precision, high surface quality of the molds for toothed belts is made possible.

This object is achieved in a method in which, using a metal-cutting tool, a matrix of the desired toothed belt toothing is incorporated into the circumference of a workpiece, which is essentially cylindrical before processing, in that at least one rotating grinding wheel having a profiled circumference is used as the metal-cutting tool, the peripheral profile corresponding to the profile of a complete tooth groove of the desired mold for toothed belts.

Therefore, the matrix for the toothed belts is not milled, but generated by grinding using specially profiled grinding wheels with a grinding motion parallel to the lengthwise central axis of the workpiece. In this way, a quality of the surface of the finished workpiece may be achieved which makes post-treatment unnecessary. The complete region from the head of one tooth to the head of the neighboring tooth is understood as a tooth groove. The grinding of two neighboring tooth grooves thus leads to a complete tooth of the mold for toothed belts being produced, i.e., the outer diameter of the mold for toothed belts is also ground. The contraction of the toothed belt material during cooling in the production process must be taken into consideration for the geometry of the tooth groove of the mold for toothed belts.

The use of profiled grinding wheels also allows extremely fine substructures to be generated easily in the tooth profile, e.g., a waved sub-profile in the region of the tooth flanks. For example, channels running parallel to the axis of the mold for toothed belts may be introduced into the profile for this purpose. Toothed belts having sub-profiles of this type are disclosed in German Patent 199 08 672 C1.

The method according to the present invention may also be implemented so that the peripheral profile of the grinding wheel is produced and/or trimmed using a CNC-controlled trimming pin. The trimming procedure is necessary due to the gradual wear of the grinding wheel. The CNC controller allows nearly any arbitrary profile to be introduced and trimmed highly precisely around the circumference of the grinding wheel and thus allows the production of varying tooth geometries in a relatively simple way.

The method according to the present invention may also be implemented so that the peripheral profile is produced and/or trimmed on a profiled trimming element having a profiled trimming region. In this case, a CNC controller may be dispensed with for the trimming, since the profiled trimming region provides a fixed profile. This may be particularly advantageous if high piece counts having identical tooth geometries are to be produced.

Finally, the method according to the present invention may also be implemented so that the trimming of the rotating grinding wheel and the subsequent grinding of the workpiece are performed in one single linear translational movement of the grinding wheel relative to the workpiece. This may be achieved through suitable positioning of the profiled trimming element. If high-precision positioning and adjustment of the profiled trimming element relative to the workpiece has been performed, the line of the profile of the trimming region of the trimming element provides the cutting shape exactly for each grinding procedure, i.e., the trimming region must lie exactly in the alignment of the desired cutting line. After the geometry of a tooth groove has been ground into the workpiece, the workpiece is rotated by an angle corresponding to the reference circle graduation of the tooth geometry. The grinding wheel is guided over the trimming region of the trimming element for re-trimming and, in a continuation of a linear translational movement, to the workpiece for the next grinding procedure. Starting from the assumption that the trimming region was not worn to a significant degree, the grinding wheel is always at the correct relative height in relation to the workpiece after the trimming. Any possible appearance of wear at the trimming region may be compensated for through manual or automatic adjustment.

The relative movement between the grinding wheel and workpiece may be achieved through a movement of the grinding wheel in relation to a machine stand or a movement of a toolholder.

The object cited above is achieved for a device, comprising a workpiece holder, means for rotation, using which at least one essentially cylindrical workpiece clamped in the workpiece holder is rotatable by a predetermined angle around its longitudinal axis in a controlled way, and a metal-cutting tool movable relative to the workpiece holder, in that the at least one tool is a grinding wheel, and trimming means are provided for trimming a specific peripheral profile of the at least one grinding wheel, the peripheral profile of the grinding wheel able to be trimmed in such a way that it corresponds to the profile of a complete tooth groove of the desired toothed belt toothing.

The device according to the present invention may also be implemented so that the trimming means includes at least one trimming pin, which has a hard body on its point facing the grinding wheel circumference, the hard body being movable relative to the associated grinding wheel both in the axial direction and in the radial direction in regard to the grinding wheel and being controllable using a programmable control unit.

For trimming, the trimming pin moves around the circumference of the rotating grinding wheel with its hard body, e.g., a diamond. Nearly any arbitrary profile shape may be produced using a CNC controller.

Furthermore, it may be advantageous to implement the device according to the present invention so that the at least one trimming pin is additionally pivotable around a trimming pivot axis, which is perpendicular to the axial and radial directions and runs through the hard body. The trimming pivot axis provides an additional variation possibility for the desired profile shapes. The hard body typically has a cross-section in the shape of a circular arc, at least in its region provided for processing workpieces. The trimming pivot axis then runs perpendicularly to this cross-section, through the center of the hard body in relation to the radius of the circular arc.

The device according to the present invention may also be implemented so that the trimming means comprise at least one profiled trimming element having a profiled trimming region, the profile of the trimming region being the counter profile of at least a part of the desired peripheral profile of the at least one grinding wheel.

This variant has the advantage that a complicated CNC controller is not necessary for the movement of the trimming means. A profiled trimming element is expedient particularly if variations of the profile shape are not necessary.

Furthermore, it may be advantageous to implement the device according to the present invention so that the profiled trimming element is a trimming hard body, made of diamond, for example, having an edge-like trimming region.

The device according to the present invention may, however, also be implemented so that the profiled trimming element is a rotatable trimming roller having a rotationally-symmetric trimming region.

The grinding wheel must always be strong enough to be able to achieve good removal with high surface quality on the workpiece. However, the grinding wheel material must still be soft enough that it does not wear the means used for trimming.

Finally, the device according to the present invention may also be implemented so that the at least one profiled trimming element is positioned and may be adjusted in relation to the workpiece holder in such a way that, viewed in the direction of the lengthwise central axis of the at least one clamped tool, the projection of the profile of the trimming region onto a tool face corresponds to the profile of the cross-section of the cut desired during a grinding procedure.

With such an arrangement, it is possible, using one single linear translational movement, to first guide the rotating grinding wheel along the profiled hard body and achieve the desired trimming of the peripheral profile of the grinding wheel at the same time, and subsequently perform the grinding procedure on the workpiece. Adjustment of the grinding wheel to the lengthwise central axis of the workpiece in the radial direction is therefore no longer necessary for the grinding procedure. In addition, it is completely unimportant how much is removed from the diameter of the grinding wheel during the trimming procedure, since the trimming edge profile or the profile of the profiled roller is exactly in alignment with the cut desired during the grinding procedure.

In the following, the present invention is explained on the basis of figures.

Figure 2:
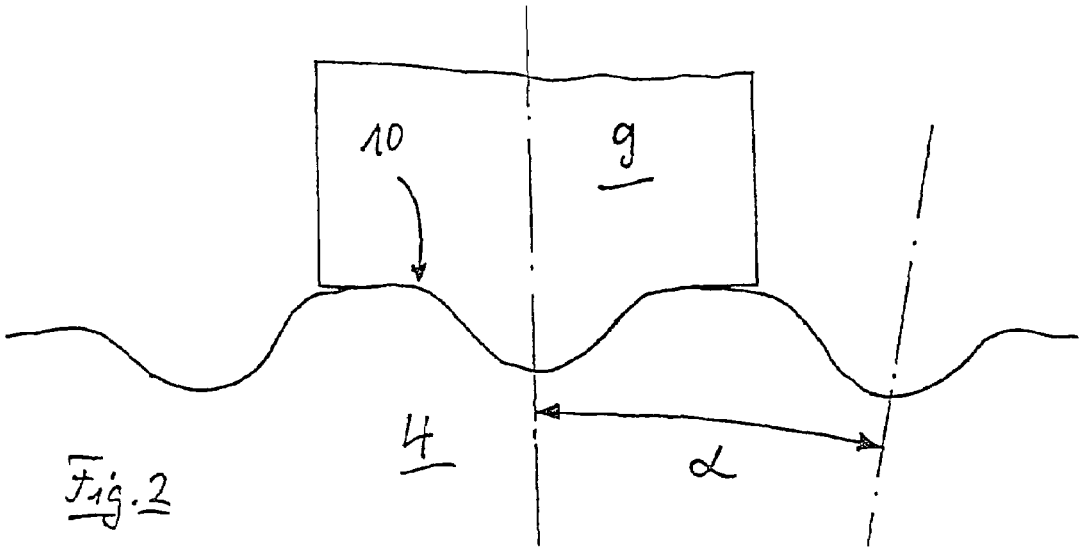
Figure 4:
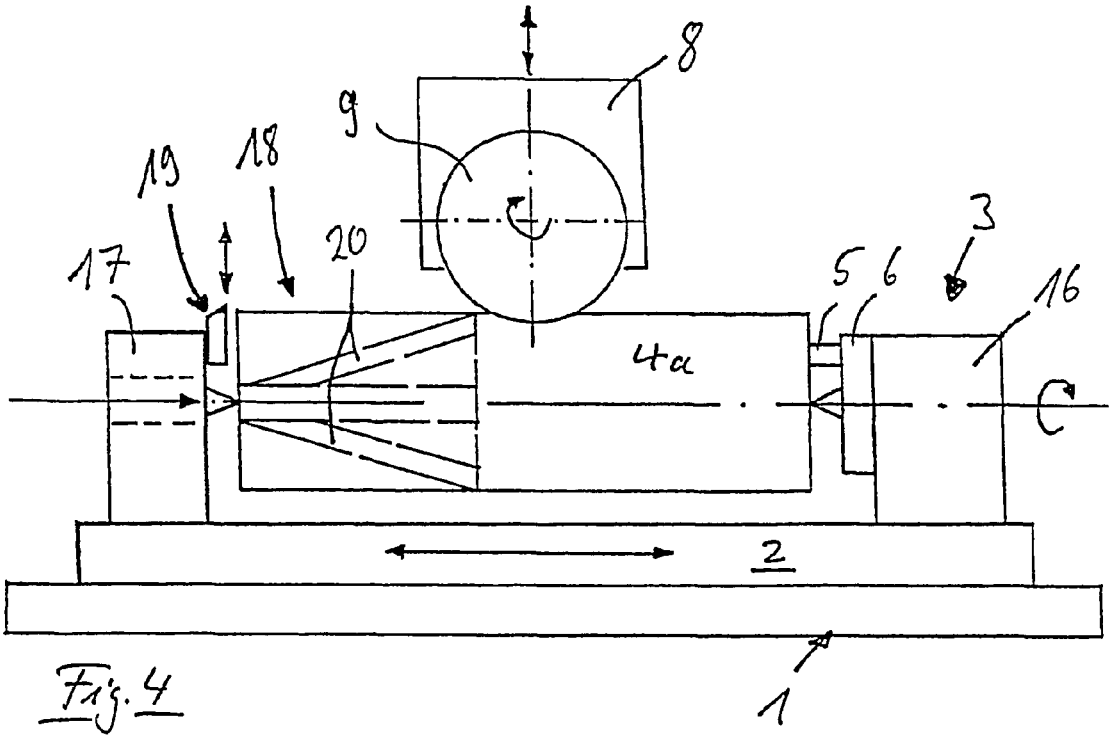
Figure 3:
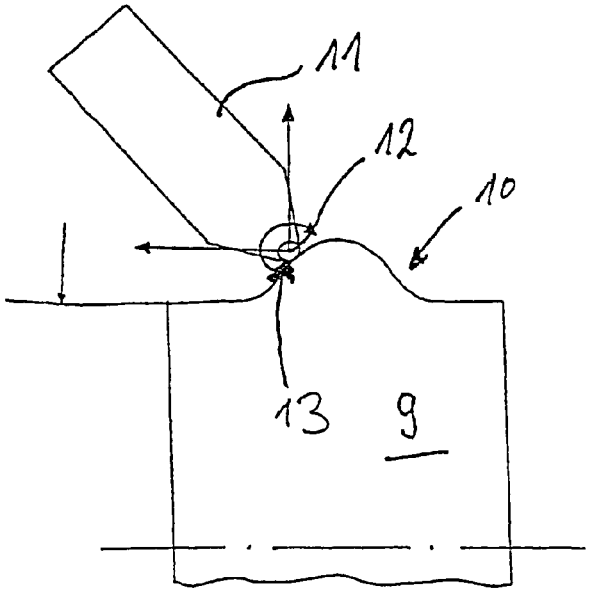
Figure 5:
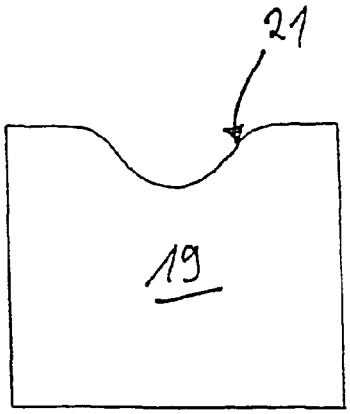

FIG. 1 schematically shows a grinding device in a side view,

FIG. 2 schematically shows a detail of a grinding wheel and a mold for toothed belts during the grinding procedure, FIG. 3 schematically shows a grinding wheel during the trimming, FIG. 4 schematically shows a further grinding device having a fixed profiling diamond, and FIG. 5 schematically shows partially a profiling diamond.

FIG. 1 shows a grinding device having a machine stand 1, to which a horizontally movable grinding table 2 is attached. The grinding table 2 supports a workpiece holder 3, in which the roller-shaped blank 4 for a mold for a toothed belt is clamped between an apparatus part 16 and an outer support 17. The blank 4 may be rotated around a horizontal axis of rotation 7 in a controlled way via a rotating driver 5 using a rotating plate 6. The axis of rotation 7 simultaneously forms the lengthwise central axis of the blank 4 in the blank 4. The workpiece holder 3 includes a high-precision direct measurement system (not shown separately here), which allows precise rotational angle setting. A grinding wheel 9 is rotatably attached to a grinding wheel holder 8 above the workpiece holder 3. The grinding wheel holder 8 may be moved highly precisely in a controlled way in the vertical direction. In order to obtain a mold for toothed belts from the blank 4, the counter profile of the toothed belt toothing must be worked into the circumference of the blank 4, the toothing being linear and constant in the direction of the lengthwise central axis of the blank 4. Viewed in cross-section, the circumference thus forms the matrix for the toothed belt toothing.

The grinding wheel 9 has a profile 10 around its circumference, which is shown in an enlarged view in FIG. 2. The peripheral profile 10 of the grinding wheel 9 corresponds to the desired profile of a tooth groove of the mold for toothed belts. To produce the mold for toothed belts, the blank 4 is moved using the grinding table 2 while the grinding wheel 9 is lowered in such a way that the grinding wheel 9 cuts the matrix for a complete tooth of the toothed belt into the blank 4 over the entire length of the blank 4. Subsequently, the blank 4 is rotated by a predetermined angle $\alpha$ and the next tooth matrix is produced. The outer diameter of the blank 4 is also ground during each grinding procedure, so that the entire peripheral surface is ground in a finished mold for toothed belts.

Since the grinding wheel 9 wears down with increasing use, the peripheral profile 10 of the grinding wheel 9 is re-trimmed using a trimming pin 11 before each grinding procedure. This is performed with the aid of a CNC process. The trimming pin 11 is movable in the axial and radial directions in relation to the rotational axis of the grinding wheel. In addition, the trimming pin 11 also has a trimming pivot axis 12, which runs essentially perpendicular to the axial and radial directions and through the center of a round diamond 13 on the tip of the trimming pin 11. Equipped with these degrees of freedom, nearly any arbitrary profile may be introduced into the circumference of the grinding wheel 9 using the trimming pin 11. In particular, it is possible to introduce fine substructures into the peripheral profile 10. Precisions of up to +/−0.01 millimeter may be achieved. In order to achieve this precision, it may be advisable to provide a variable advance speed of the trimming pin 11, so that, for example, a lower advance speed is used in the regions of smaller radii in the peripheral profile 10. Furthermore, a virtual diamond radius may be preset for the CNC controller. In this way a constant deviation from the ideal line in the profile line may be easily corrected, for example, without having to change the entire CNC programming.

The grinding wheel is continuously cleaned with the aid of a pair of spray nozzles 14 (FIG. 1), which reach both sides of the peripheral profile 10 sufficiently uniformly, for the trimming procedure.

During the grinding procedure, a further pair of spray nozzles 15 is used, which cleans the grinding wheel 9 at high pressure and thus prevents it from clogging. The pair of nozzles 15 is positioned in direct proximity to the grinding wheel 9.

In order to make the entire process cost-effective, it may be expedient to prepare the blank 4 using known milling machines, so that the grinding wheel 9 wears less.

FIG. 4 shows an alternative construction of a grinding device. Parts corresponding to one another are provided with the same reference numbers in different figures. The blank 4*a* is shorter in FIG. 4 than in FIG. 1. The workpiece holder 3 has the same spacing in its apparatus parts 16 and 17 as in FIG. 1. However, it is provided with a length adapter 18, which has struts 20. With the aid of one or more length adapters 18, adjustment of apparatus parts 16 and 17 of the workpiece holder 3 may be avoided even in the event of different lengths of blanks 4*a*, in order to maintain high precision in the spacing, which is achieved once in a complicated way.

A profiling diamond 19, which is used for trimming the grinding wheel 9 and is shown enlarged in FIG. 5, is positioned on the outer support 17. The profiling diamond 19 has a trimming edge 21, whose profile corresponds to the profile of the desired tooth groove of the mold for toothed belts. Before a grinding procedure, the grinding table 2 is brought into the starting position, in which the grinding wheel 9 is positioned to the left of the profiling diamond 19 in FIG. 4. The grinding wheel holder 8 is then lowered enough that during movement of the grinding table 2 to the left (in FIG. 4), the outer circumference of the rotating grinding wheel 9 is provided with the corresponding counter profile by the trimming edge 21 of the profiling diamond 19. The outer circumference of the grinding wheel 9 thus obtains the profile of a complete tooth groove of the desired mold for toothed belts.

The profiling diamond 19 is aligned in such a way that, through further movement of the grinding table 2, the grinding wheel reaches the workpiece 4*a* in the correct operating position without a vertical change in position and produces the matrix for a complete tooth of the toothed belt, including the tooth root, in one single grinding procedure. Subsequently, the grinding wheel holder 8 is raised and the grinding table 2 is moved back to the starting position. The grinding wheel holder 8 is lowered again, however, it is lowered slightly more than for the preceding pass due to the wear caused during the grinding procedure. In this way, the circumference of the grinding wheel 9 is newly trimmed before each grinding. Since the position of the trimming edge 21 remains unchanged in relation to the axis of rotation 7, it is additionally ensured that the grinding wheel 9 again reaches the workpiece 4*a* in the correct operating position and the matrices of the toothed belt teeth ground into the workpiece 4*a* are exactly identical in regard to the tooth geometry and the tooth height. In this way, the complete circumference of the mold for toothed belts, including the outer diameter, is ground using the grinding wheel 9.

The profiling diamond 19 is attached so its position may be changed in the vertical direction, in order that possible wear may be compensated for or adjustment to a different workpiece diameter is possible.

| List of reference numbers | |
|---|---|
| 1 | machine stand |
| 2 | grinding table |
| 3 | workpiece holder |
| 4 | blank |
| 5 | rotating driver |
| 6 | rotating plate |
| 7 | axis of rotation |
| 8 | grinding wheel holder |
| 9 | grinding wheel |
| 10 | peripheral profile |
| 11 | trimming pin |
| 12 | trimming pivot axis |
| 13 | diamond |
| 14 | pair of spray nozzles |
| 15 | nozzle |
| 16 | apparatus part |
| 17 | outer support |
| 18 | length adapter |
| 19 | profiling diamond |
| 20 | strut |
| 21 | trimming edge |

The invention claimed is:

1. A method of producing molds for toothed belts comprising:

obtaining a workpiece, said workpiece being cylindrical and having a longitudinal axis and a circumferential surface;

obtaining a metal-cutting tool, said cutting tool having at least one rotating grinding wheel, said grinding wheel rotating about an axis perpendicular to said longitudinal axis having a profiled circumferential surface, said profiled circumferential surface comprising a convex central region;

applying said rotating grinding wheel against the workpiece circumferential surface and simultaneously translating the workpiece along the longitudinal axis of the workpiece for forming a matrix of tooth belt toothing into said circumferential surface of said workpiece, said matrix of toothing corresponding to said profiled circumferential surface.

2. The method according to claim 1, further comprising:

obtaining a CNC controlled trimming pin; and trimming said profile onto said circumferential surface grinding wheel with said CNC controlled trimming pin.

3. The method according to claim 1, further comprising:

obtaining a profile trimming element, said trimming element having a profiled trimming region; and trimming said profile circumferential surface onto said grinding wheel with said trimming region of said profiled trimming element.

4. The method according to claim 3, comprising:

trimming said rotating grinding wheel and grinding said workpiece in a single linear translational movement of said grinding wheel relative to said workpiece.

5. A device for producing molds for providing toothed matrices on a cylindrical workpiece, having a circumferential surface and a longitudinal axis, said device comprising:

a workpiece holder, said workpiece holder holding said workpiece;

rotating means for angularly rotating said workpiece about said longitudinal axis on said workpiece holder;

a cutting tool including a grinding wheel having a rotating axis perpendicular to said longitudinal axis and having a profiled circumferential surface, said profiled circumferential surface comprising a convex central region;

means for translating said work-piece along said workpiece longitudinal axis;

trimming means for trimming a profiled circumferential surface onto said grinding wheel, said profiled circumferential surface comprising a peripheral profile defining a counter profile for a toot for a toothed belt;

said trimming means comprising a profiled trimming element, said profiled trimming element having a profiled trimming region, said profiled trimming region having a counter profile of said profiled circumferential surface of said grinding wheel.

6. The device of claim 5 wherein said profiled trimming element is a diamond.

* * * * *